US006321650B1

(12) United States Patent
Ogawa et al.

(10) Patent No.: US 6,321,650 B1
(45) Date of Patent: Nov. 27, 2001

(54) PAPER WEB FEED UNIT USED IN A ROTARY PRESS AND EQUIPPED WITH A PAPER WEB TRAVELING TENSION CONTROLLER

(75) Inventors: Yukio Ogawa, Chigasaki; Makoto Tsunashima, Kawasaki; Takanobu Sakakura, Inaki; Kazuo Serita, Kawasaki, all of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/437,397

(22) Filed: Nov. 10, 1999

(30) Foreign Application Priority Data

Jun. 17, 1999 (JP) ..... 11-170380

(51) Int. Cl.[7] ..... B41F 13/56
(52) U.S. Cl. ..... 101/227; 101/219; 101/485
(58) Field of Search ..... 101/227, 485, 101/219

(56) References Cited

U.S. PATENT DOCUMENTS 4,452,140 * 6/1984 Isherwood et al. ..... 101/181
5,361,960 * 11/1994 Fokos et al. ..... 226/2
5,483,893 * 1/1996 Isaac et al. ..... 101/485
5,927,196 * 7/1999 Murray ..... 101/219
6,142,074 * 11/2000 Flament ..... 101/219

FOREIGN PATENT DOCUMENTS 51-7083 3/1976 (JP) .

* cited by examiner

*Primary Examiner*—John S. Hilten
*Assistant Examiner*—Marvin P. Crenshaw
(74) *Attorney, Agent, or Firm*—Armstrong, Westerman, Hattori, McLeland & Naughton, LLP

(57) ABSTRACT

In a paper web feed unit of a rotary press, a paper web taken out of a paper roll is longitudinally cut into first and second cut paper webs, which are fed out toward the downstream side by a driven roller of a feed-out mechanism, and only the first cut paper web is passed through an angle bar section for transferring the traveling path of the first cut paper web. The paper web feed unit is equipped with a paper web traveling tension controller which comprises a dancer roller mechanism for independently applying a predetermined pushing pressure to each of the first cut paper web passing through the angle bar section and the second cut paper web not passing through the angle bar section, a detector for detecting the positions of dancer rollers moved in a synchronized manner, and a controller for receiving a detection signal output from the detector and for outputting a control signal to a motor for the driven roller in order to control the rotational frequency of the driven roller to thereby maintain each of the dancer rollers at a constant position.

8 Claims, 4 Drawing Sheets

PAPER WEB FEED UNIT USED IN A ROTARY PRESS AND EQUIPPED WITH A PAPER WEB TRAVELING TENSION CONTROLLER

BACKGROUND OF THE INVENTION

1. Field of the Invention

The present invention relates to a paper web feed unit used in a rotary press and equipped with a paper web traveling tension controller, and more particularly to a paper web feed unit which is used in a rotary press and in which a paper web having a width double that of paper used in a press unit is longitudinally cut, by use of cutting means, into two cut paper webs having substantially the same width; only one of the cut paper webs is passed through an angle bar section; and the traveling tension of each cut paper web is controlled by use of a paper web traveling tension controller.

2. Description of the Related Art

Japanese Patent Publication (kokoku) No. 51-007083 discloses a conventional rotary press in which a paper web is longitudinally cut, by use of cutting means, into two cut paper webs having substantially the same width; the first cut paper web is fed to a first press unit via an angle bar section; and the second cut paper web is fed directly to a second press unit without passing through the angle bar section.

In the rotary press, while the first cut paper web passes through the angle bar section, the traveling path thereof is transferred such that the first cut paper web is fed to the first press unit in a state in which the center line thereof is aligned with the center line of the second cut paper web that is fed to the second press unit.

Further, a traveling tension controller as disclosed in "Newspaper Printing Handbook," pp. 111–112, published by Japanese Newspapers Association, Apr. 10, 1997 (§3 "Newspaper Offset Rotary Press," (2) Infeed Tension) has generally been used to control the traveling tension of a paper web fed to a press unit.

The traveling tension controller is used to stabilize the traveling tension of a paper web fed to a press unit and is designed to control the traveling tension of the paper web at a location before the press unit by use of an infeed roller and a dancer roller.

FIG. 4 shows such a traveling tension controller combined with the above-described rotary press.

In FIG. 4, a paper web WO' having a width double that of paper used in an unillustrated press unit of a rotary press is taken out of a paper roll W' and is longitudinally cut, by use of cutting means C', into two cut paper webs having substantially the same width. Subsequently, a first cut paper web W1' of a single width is passed through an angle bar section D', so that the center line of the first cut paper web W1' coincides with the center line of a second cut paper web W2' of a single width.

For the cut paper webs W1' and W2', paper web traveling tension controllers T1 and T2 are provided in order to enable the cut paper webs W1' and W2' to be fed to respective press units while their traveling tensions are controlled independently.

The paper web traveling tension controller T1 (T2) includes a dancer roller 42*a* (42*b*) connected to a fluid cylinder 41*a* (41*b*). The dancer roller 42*a* (42*b*) applies a pushing pressure to the cut paper web W1' (W2') due to projection of the piston rod of the fluid cylinder 41*a* (41*b*), and moves in accordance with variation in the traveling tension of the cut paper web W1' (W2').

Further, an infeed roller 43*a* (43*b*) driven by a drive source 45*a* (45*b*) is provided upstream of the dancer roller 42*a* (42*b*); and a sensor 44*a* (44*b*) for detecting the position of the dancer roller 42*a* (42*b*) is attached to the fulcrum of a support arm of the dancer roller 42*a* (42*b*). The drive source 45*a* (45*b*) receives a detection signal from the sensor 44*a* (44*b*) and changes the circumferential speed of the infeed roller 43*a* (43*b*) in order to control the amount of the paper web fed to the dancer roller 42*a* (42*b*) such that the dancer roller 42*a* (42*b*) is always located at a neutral position (ordinary position) in the slack/tension direction of the cut paper web W1' (W2').

Thus, a stable traveling tension is applied to the cut paper web W1' (W2') fed to the press unit.

The above-described conventional techniques involve various drawbacks, as described below.

In the rotary press disclosed in Japanese Patent Publication No. 51-007083, no paper web traveling tension controller is provided in a paper threading path extending from the cutting means of the paper web feed unit where a paper web taken out of the paper roll is cut to the press unit. Therefore, when the traveling tension of the cut paper web changes (for example, decreases) due to resistance of rollers for supporting and guiding the cut paper web and a paper dragging operation performed downstream of the press unit, the traveling cut paper web slacks and meanders, resulting in paper breakage or other problems. On the contrary, when the traveling tension of the cut paper web increases, wrinkles are generated in the traveling cut paper web, also resulting in paper breakage or other problems.

In order to overcome the above-mentioned drawbacks, as shown in FIG. 4, the above-described paper web traveling tension controller is combined with the rotary press disclosed in Japanese Patent Publication No. 51-007083. However, the rotary press shown in FIG. 4 has a drawback in that a difference in traveling state is produced between the cut paper web W1'—which travels from the cutting means C' to the infeed roller 43*a* along a paper threading path containing an angle bar section D' which generates extremely high friction resistance—and the cut paper web W2'—which travels from the cutting means C' to the infeed roller 43*b* along a paper threading path containing no angle bar section.

That is, when the rotary press is started and the supply of cut paper webs W1' and W2' to the respective press units is started at the same paper speed by means of paper drag rollers (not shown) provided downstream of the press units, the dancer rollers 42*a* and 42*b* of the paper web traveling tension controllers T1 and T2 start to move in the tensing direction of the cut paper webs W1' and W2' (rightward in FIG. 4) as the traveling tensions of the cut paper webs W1' and W2' increase. However, due to the action of the infeed rollers 43*a* and 43*b*, the dancer rollers 42*a* and 42*b* are controlled to return to the respective neutral positions (ordinary positions).

In the above-described case, since the cut paper web W1' is subjected to the high friction resistance of the angle bar section D', the cut paper web W1' elastically deforms and stretches in a region between the angle bar section D' and the infeed roller 43*a*, and thus travels slightly slower than the cut paper web W2' in a region between the cutting means C' and the angle bar section D'. As a result, in the region between the cutting means C' and the angle bar section D', a difference in traveling tension is produced between the cut paper web W1' and the cut paper web W2', with the result that the cut paper web W1' slacks.

However, when the rotary press is operated continuously, the difference between the traveling tension of the cut paper web W1' in the region between the cutting means C' and the angle bar section D' and the traveling tension of the cut paper web W1' in the region between the angle bar section D' and the infeed roller 43*a* converges to a constant value determined from the friction resistance between the angle bar section D' and the cut paper web W1', and in this state, the cut paper web W1' starts to travel at substantially the same speed as the cut paper web W2'. Therefore, no significant problems occur.

However, when low speed operation and stoppage of the rotary press are performed repeatedly many times within a short period of time; for example, in a work step in which an operator attaches a printing plate onto a plate cylinder, the difference between the traveling tension of the cut paper web W1' in the region between the cutting means C' and the angle bar section D' and that in the region between the angle bar section D' and the infeed roller 43*a* does not converge to a constant value, even though the rotation of the infeed roller 43*a* is controlled such that the dancer roller 42*a* returns to the neutral (ordinary) position. In this case, the cut paper web 1' travels intermittently, with the result that the amount of slack in the cut paper web W1' at a region downstream of the cutting means C' increases.

By contrast, unlike the cut paper web W1', the cut paper web W2' does not slack, with the result that at a location where the cutting means C' cuts the paper web W0', the cut paper web W2' comes into a slightly pulled state as compared to the cut paper web W1'.

Therefore, a cut line formed by the cutting means C' meanders or skews slightly.

When the cut paper web W1' and the cut paper web W2' are caused to travel simultaneously upon a speed increasing operation after start of printing, a large difference in traveling tension is suddenly produced between the cut paper web W1' and the cut paper web W2' in a region immediately after the cutting means C', with the result that one or both of the cut paper webs W1' and W2' is broken, and a slacked portion of the cut paper web W1' is caught by the cutting means C' or other rollers, which stops the operation.

Accordingly, there has been a strong desire for a paper web traveling tension controller which can be used in the structure in which a paper web taken out of a paper roll is longitudinally cut, by means of cutting means, into two cut paper webs having substantially the same width, and one of cut paper webs is passed through an angle bar section in order to transfer the traveling path of the cut paper web; which prevents sudden generation of a large difference in traveling tension between the two cut paper webs which would otherwise be generated in a region downstream of the cutting means when the rotary press is operated intermittently at slow speed; and which does not cause any problem during continuous operation of the rotary press.

SUMMARY OF THE INVENTION

An object of the present invention is to provide a paper web feed unit used in a rotary press and equipped with a paper web traveling tension controller which prevents sudden generation of a large difference in traveling tension between two cut paper webs which would otherwise be generated in a region downstream of the cutting means when the rotary press is operated intermittently at slow speed, and which does not cause any problem during continuous operation of the rotary press.

The present invention provides a paper web feed unit used in a rotary press in which a paper web taken out of a paper roll passes through the paper web feed unit and a press unit along a paper threading path having guide rollers. The paper web feed unit comprises feed-out means, cutting means, an angle bar section, and a paper web traveling tension controller. The feed-out means is rotated by drive means and is adapted to feed to a downstream side the paper web wound around the outer circumferential surface of the feed-out means, by means of frictional force between the outer circumferential surface of the feed-out means and the paper web. The cutting means cuts the traveling paper web into first and second cut paper webs having substantially the same width. The angle bar section comprises angle bars around which only the first cut paper web is wound, so that the traveling path of the first cut paper web is transferred. The paper web traveling tension controller controls the traveling tensions of the first and second cut paper webs in a region downstream of the angle bar section.

The paper web traveling tension controller comprises dancer roller means, detection means, and control means. The dance roller means comprises a first rotatable dancer roller around which the first cut paper web passing through the angle bar section is wound, and a second rotatable dancer roller around which the second cut paper web not passing through the angle bar section is wound. The first and second dancer rollers can move in a synchronized manner in order to change the lengths of respective traveling paths along which the first and second cut paper webs travel, and a predetermined pushing pressure is applied to each of the first and second dancer rollers in a direction for increasing the length of the traveling path of the corresponding cut paper web. The detection means detects the positions of the first and second dancer rollers. The control means receives a detection signal output from the detection means and outputs a control signal to the drive means in order to control the rotational frequency of a driven roller of the feed-out means to thereby maintain each of the first and second dancer rollers at a constant position.

Preferably, the dancer roller means further comprises a first movable arm having a free end which rotatably supports the first dancer roller, a second movable arm having a free end which rotatably supports the second dancer roller, pressing means for individually applying a pushing pressure to each of the first and second movable arms in order to move the corresponding dancer roller toward a direction for increasing the length of the traveling path of the cut paper web wound around the corresponding dancer roller, and a link for coupling the first and second movable arms to each other such that the first and second dancer rollers move simultaneously in a synchronized manner; and the detection means detects positions of the first and second dancer rollers through detection of an angular position of one of the first and second movable arms.

Preferably, the angle bar section comprises two parallel bars which are disposed with a predetermined distance therebetween such that the bars skew with respect to the driven roller, whereby the traveling path of the first cut paper web wound around the bars is transferred to become parallel to the traveling path of the second cut paper web not passing through the angle bar section.

In the paper web feed unit according to the present invention, no large difference in traveling tension is produced between the first cut paper web and the second cut paper web in a region right downstream the cutting means, even when the press units are intermittently operated at low speed.

As a result, even when the rotary press is intermittently operated at low speed for preparation of the regular operation, and subsequently the speed of the rotary press is increased upon start of the regular operation, no large difference in traveling tension is produced between the two cut paper webs, so that the two cut paper webs travel smoothly to the respective press units.

Accordingly, it becomes possible to prevent occurrence of problems such as web breakage during regular operation of the rotary press, to thereby reduce the amount of spoilage and the amount of labor required for troubleshooting.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A paper web feed unit used in a rotary press and equipped with a paper web traveling tension controller according to an embodiment of the present invention will next be described with reference to the drawings.

Figure 3:
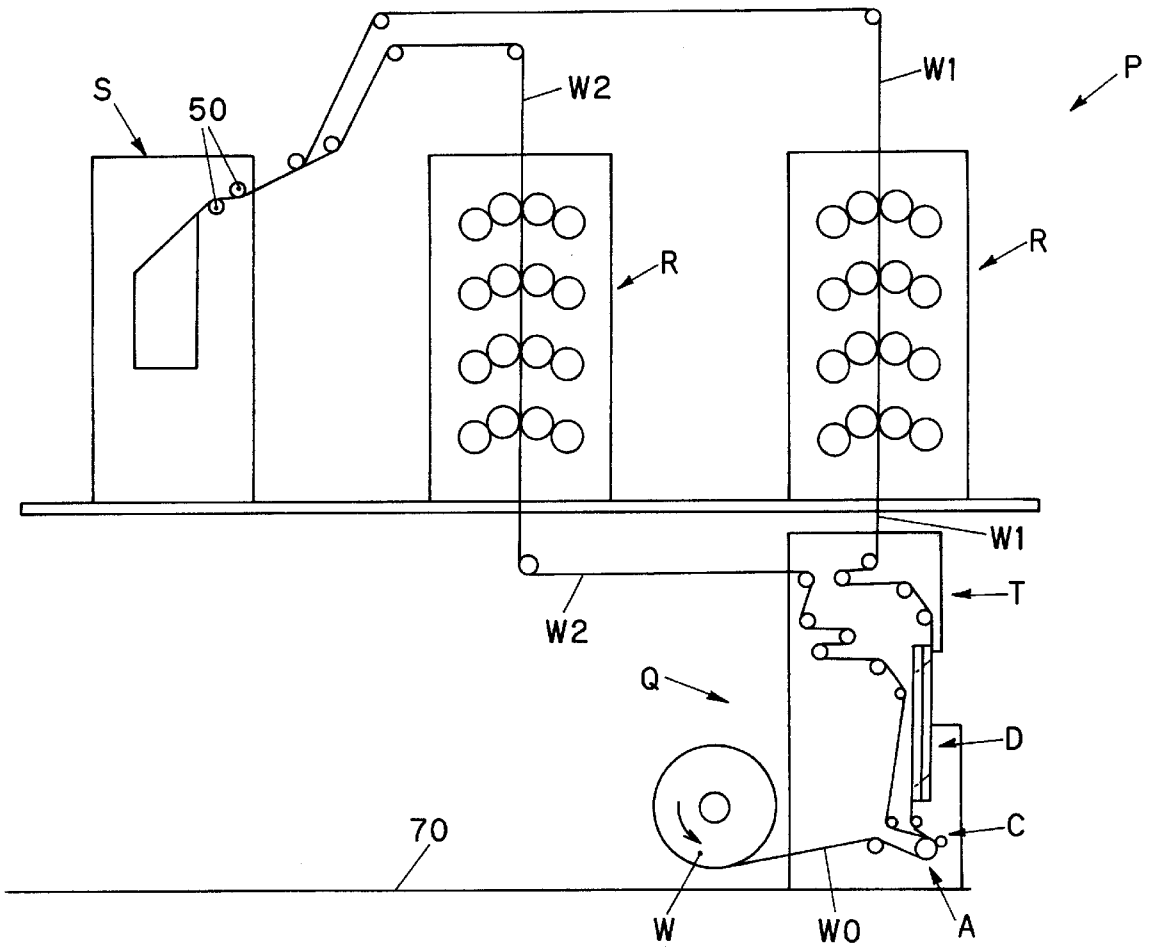
FIG. 3 is a view showing the structure of a rotary press equipped with the paper web traveling tension controller shown in FIG. 1.
Figure 4:
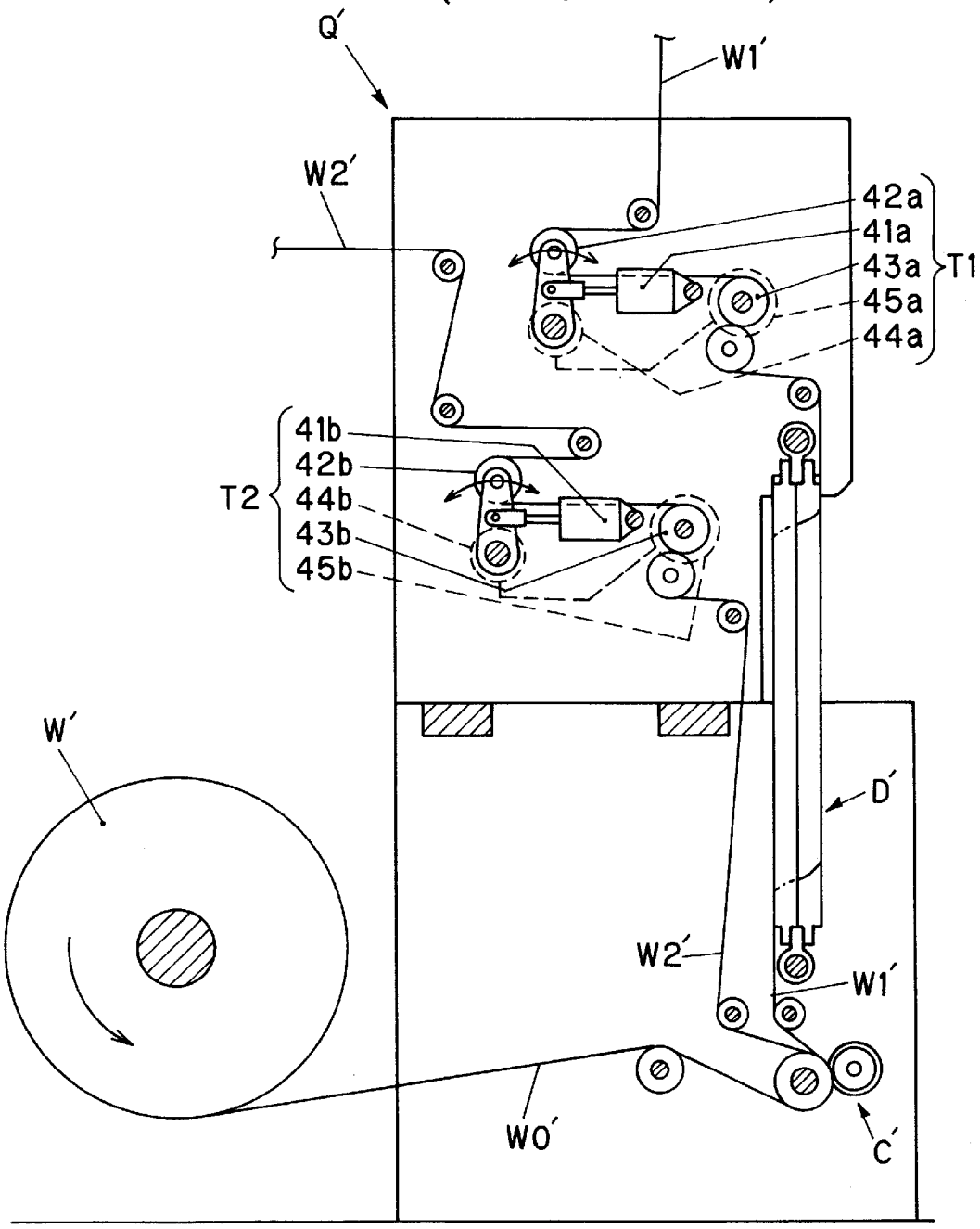
FIG. 4 (PRIOR ART)
FIG. 4 is a front view of a conventional paper web traveling tension controller for a rotary press.

As shown in FIG. 3, an exemplary rotary press P comprises a plurality (two in this example) of press units R disposed above a paper web feed unit Q provided on a base 70, and a folding unit S having drag rollers 50 is disposed adjacent to the press units R.

The paper web feed unit Q comprises a paper roll support provided on an unillustrated frame and adapted to rotatably support a paper roll W. The paper web feed unit Q further comprises feed-out means A, an angle bar section D, and a paper web traveling tension controller T, which are provided in this sequence from the lower side to the upper side of frames provided on the base 70. The feed-out means A has cutting means C and is driven by drive means B.

The paper roll support, the feed-out means A, the angle bar section D, the paper web traveling tension controller T, the press units R, the folding unit S, and guide rollers provided therebetween form two paper threading paths.

In the rotary press P, while following the paper threading paths, a paper web W0 taken out of the paper roll W passes through the feed-out means A having the cutting means C, the angle bar section D, the paper web traveling tension controller T, and the press units R, and then reaches the folding unit S. More specifically, the paper web W0 having a width double that of paper used in the press units R is longitudinally cut, by the cutting means C, into two cut paper webs W1 and W2 having substantially the same width. Only the first cut paper web W1 is passed through the angle bar section D, where the traveling path of the first cut paper web W1 is transferred such that the first cut paper web W1 is aligned widthwise with the second cut paper web W2.

Subsequently, the cut paper webs W1 and W2 are caused to travel to the respective press units R, while their traveling tensions are controlled by the paper web traveling tension controller T. After being printed in the press units R, the cut paper webs W1 and W2 are superposed on each other and fed to the folding unit S by means of the drag rollers 50. In the folding unit S, the cut paper webs W1 and W2 are cut to predetermined lengths, and cut paper sheets are folded in the form of a signature, which is then discharged from the folding unit S.

The paper web feed unit Q will be described in more detail with reference to FIGS. 1 and 2. Frames 30 and 31—which support the paper web traveling tension controller T, the angle bar section D, and the feed-out means A equipped with the cutting means C—are disposed on the base 70 such that the frames 30 and 31 face each other with a distance therebetween greater than the width of the paper web W0, and two parallel stays 34 are disposed between the upper ends of the frames 30 and 31.

Another frame 33 is disposed on the upper end of the frame 31 to extend upward therefrom, and yet another frame 32 facing the frame 33 is provided to straddle the stays 34 at a position offset toward the frame 30 from the center between the frames 30 and 31.

The above-described feed-out means A, the drive means B, and the cutting means C are disposed between the frames 30 and 31. The feed-out means A has a driven roller 2 for feeding to the downstream side the paper web W0 taken out of the paper roll W of the paper roll support. The drive means B drives the driven roller 2. The cutting means C cuts the paper web W0 longitudinally into two cut paper webs W1 and W2 having substantially the same width. The above-described angle bar section D for transferring the traveling path of the first cut paper web W1 is disposed across the space between the frames 30 and 31 and the space between the frames 32 and 33.

Further, dancer roller means E and detection means F are provided between the frames 30 and 31. The dancer roller means E comprises dancer rollers 5*a* and 5*b* and fluid cylinders 8*a* and 8*b* which produce pushing pressures from the piston rods thereof. The pushing pressures are applied via the dancer rollers 5*a* and 5*b* to the cut paper web W1 passing through the angle bar section D and the cut paper web W2 not passing though the angle bar section D. The detection means F detects the positions of the dancer rollers 5*a* and 5*b*. Further, control means G is provided at an appropriate position. The control means G receives a detection signal output from the detection means F and outputs a control signal to the drive means B in order to control the rotational frequency of the driven roller 2 of the feed-out means A such that each of the dancer rollers 5*a* and 5*b* is maintained at a constant position; i.e., at an ordinary position.

Next, each of the above-described means A–G will be described in further detail.

In the feed-out means A, the opposite end portions of a rotation shaft 1 concentrically integrated with the driven roller 2 are rotatably supported by the frames 30 and 31, and one end portion projects outward from the frame 30 as a projected end portion 1*a*. An annular groove is formed circumferentially in the outer surface of the driven roller 2 at an axially central position such that a disk blade 4*a* of the cutting means C, which will be described later, can enter the groove.

Between the driven roller 2 and the paper roll support, a guide roller 61 is disposed parallel to the driven roller 2 at a position close thereto, and the opposite shaft end portions of the guide roller 61 are rotatably supported by the frames 30 and 31.

The drive means B comprises a motor 3 attached to the outer wall of the frame 30 via a bracket 3*a*. The output shaft of the motor 3 is connected to the projected end portion 1*a* of the rotation shaft 1 via a shaft coupling.

The cutting means C comprises a block 4 which rotatably supports the shaft of the disk blade 4*a* and is equipped with a motor for rotating the shaft in a manner interlocked with the operation of the rotary press. The block 4 is attached to the frames 30 and 31 via an unillustrated bracket such that the circumferential cutting edge of the disk blade 4*a* can enter and exit from the annular groove of the driven roller 2. When the disk blade 4*a* is rotated by the motor 3 in a state in which the circumferential cutting edge of the disk blade 4*a* is located in the annular groove of the driven roller 2, the paper web W0, which travels while being supported by the outer circumferential surface of the driven roller 2, is divided into two portions having substantially the same width.

Figure 2:
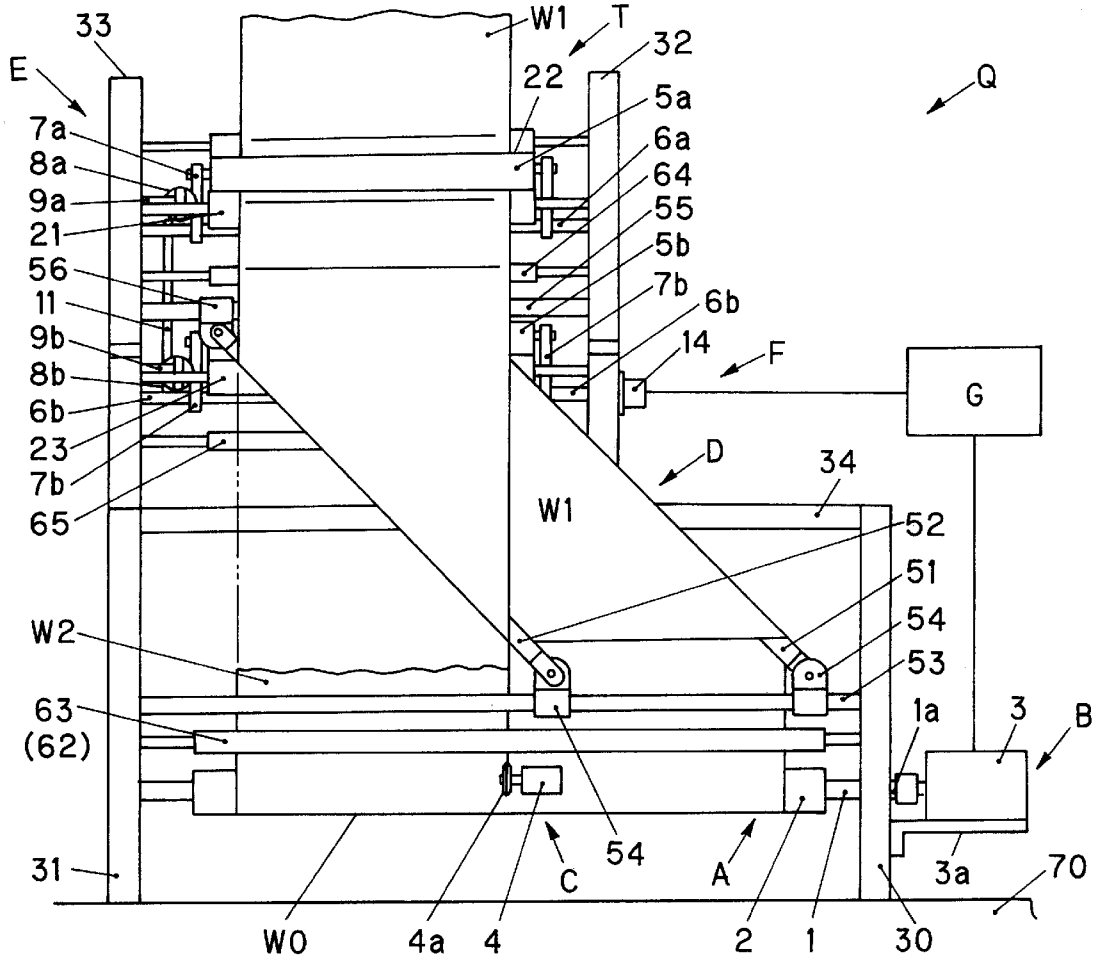
FIG. 2 is a side view as viewed from the direction of arrow II in FIG. 1.

As shown in FIG. 2, the angle bar section D comprises two parallel bars 51 and 52 disposed with a predetermined distance therebetween such that the bars 51 and 52 skew with respect to the driven roller 2 and extend across the space between the frames 30 and 31 and the space between the frames 32 and 33. Specifically, the first ends of the bars 51 and 52 are attached, via attachment members 54, to a shaft 53 whose opposite ends are supported by the frames 30 and 31, and the second ends of the bars 51 and 52 are attached, via attachment members 56, to a shaft 55 whose opposite ends are supported by the frames 32 and 33.

Each of the attachment members 54 and 56 is movable in the axial direction and can be fixed in at least one desired position, and the first and second ends of the bars 51 and 52 are coupled to the attachment members 54 and 56. Therefore, the distance between and inclination of the bars 51 and 52 can be adjusted.

The attachment members 54 are positioned on the shaft 53 such that one attachment member 54 is located at the approximate center of the shaft 53, and the other attachment member 54 is located to substantially correspond to the outer edge of the cut paper web W1. The attachment members 56 are positioned on the shaft 55 such that one attachment member 56 is located to substantially correspond to the outer edge of the cut paper web W2, and the other attachment member 56 is located to substantially correspond to the cut edge of the cut paper web W2.

Accordingly, since the cut paper web W1 is turned by and wound around the bars 51 and 52, the traveling direction of the cut paper web W1 is changed by the bar 51 to a direction corresponding to the inclination of the bar 51 and then changed by the bar 52 to a direction parallel to the traveling direction of the cut paper web W2 (see FIG. 2).

Between the driven roller 2 and the shaft 53, guide rollers 62 and 63 are disposed parallel to the driven roller 2, and the opposite shaft end portions of the guide rollers 62 and 63 are rotatably supported by the frames 30 and 31. Each of the guide rollers 61, 62, and 63 functions as a snub roller for increasing the winding angle of the paper web around the driven roller 2.

The dancer roller means E comprises parallel rotation shafts 6*a* and 6*b* which are disposed horizontally while being vertically separated from each other, the opposite ends of the rotation shafts 6*a* and 6*b* being supported by the frames 32 and 33. The base end portions of movable arms 7*a* directed upward are integrally attached to the opposite end portions of the rotation shaft 6*a*, so that the movable arms 7*a* create angular displacements together with the rotation shaft 6*a*. Similarly, the base end portions of movable arms 7*b* directed upward are integrally attached to the opposite end portions of the rotation shaft 6*b*, so that the movable arms 7*b* create angular displacements together with the rotation shaft 6*b*.

The shaft of the dancer roller 5*a* is supported by the free ends of the movable arms 7*a*, and the shaft of the dancer roller 5*b* is supported by the free ends of the movable arms 7*b*.

The fluid cylinders (air cylinders) 8*a* and 8*b* are provided for the movable arms 7*a* and 7*b* to be located on the side where the frame 33 is present. The projection end of the piston rod of the fluid cylinders 8*a* is pin-connected to an intermediate portion of the movable arm 7*a* via a coupling member 10, and the projection end of the piston rod of the fluid cylinders 8*b* is pin-connected to an intermediate portion of the movable arm 7*b* via another coupling member 10. The base end portions of the fluid cylinders 8*a* and 8*b* are pivotally supported by shaft pins 9*a* and 9*b* which are attached to the frame 33 to project toward the inner side of the frame 33. That is, the movable arms 7*a* and 7*b* and the fluid cylinders 8*a* and 8*b* can create angular displacements about parallel axes.

Further, coupling members 12*a* and 12*b* are attached to the intermediate portions of the movable arms 7*a* and 7*b* such that the coupling members 12*a* and 12*b* project toward the side opposite the fluid cylinders 8*a* and 8*b*. The opposite ends of a connecting rod 11 are coupled to the coupling members 12*a* and 12*b* via pins 13*a* and 13*b*.

In the above-described configuration, the movable arms 7*a* and 7*b*, the coupling members 12*a* and 12*b*, and the connecting rod 11 constitute a link, and further constitute a link mechanism together with the rotation shafts 6*a* and 6*b* and the pins 13*a* and 13*b*. Accordingly, the dancer roller 5*a* and the dancer roller 5*b* move simultaneously in an interlocked manner.

Compressed air of a predetermined constant pressure is supplied from, for example, a compressed air supply pipe (not shown) to the fluid cylinders 8*a* and 8*b*, so that their piston rods project under pressure.

In the dancer roller means E, paired lower and upper guide rollers 21 and 22 are provided on one side (right side in FIG. 1) of the dancer roller 5*a* where the fluid cylinder 8*a* is present, and paired lower and upper guide rollers 23 and 24 are provided on one side (right side in FIG. 1) of the dancer roller 5*b* where the fluid cylinder 8*b* is present.

Figure 1:
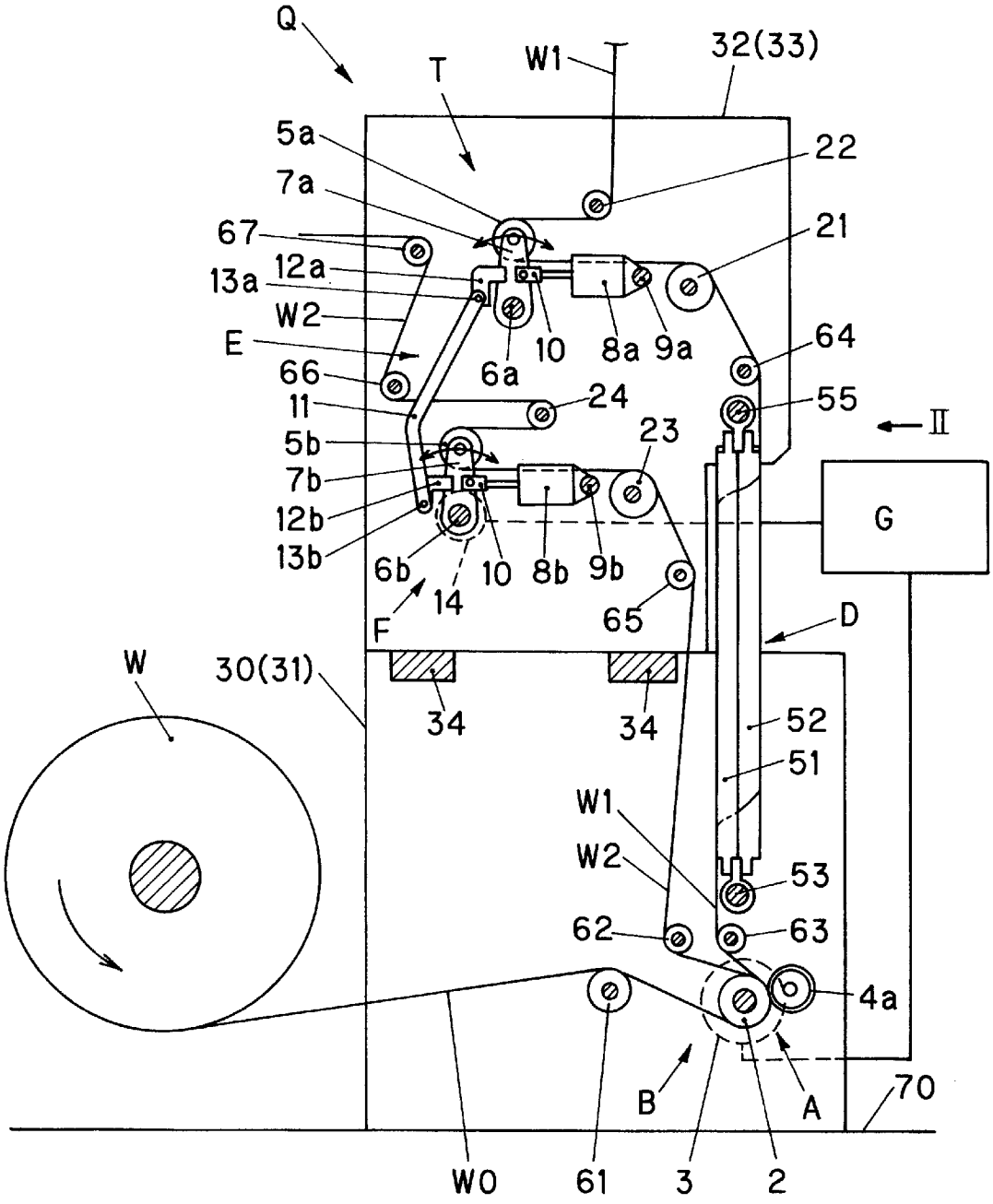
FIG. 1 is a front view of a paper web traveling tension controller according to an embodiment of the present invention.

The guide rollers 21 and 22 are arranged such that the cut paper web W1 wound therearound travels toward the dancer roller 5*a* from the side of the fluid cylinder 8*a* (from the right side in FIG. 1), travels along the dancer roller 5*a* from the lower side to the upper side, and reverses direction to travel toward the side of the fluid cylinder 8*a* (toward the right side in FIG. 1). Similarly, the guide rollers 23 and 24 are arranged such that the cut paper web W2 wound therearound travels toward the dancer roller 5*b* from the side of the fluid cylinder 8*b* (from the right side in FIG. 1), travels along the dancer roller 5*b* from the lower side to the upper side, and reverses direction to travel toward the side of the fluid cylinder 8*b* (toward the right side in FIG. 1).

Through the action of the fluid cylinders 8*a* and 8*b*, their piston rods tend to project appropriately. Therefore, when the traveling tensions of the cut paper webs W1 and W2 decrease, the movable arms 7*a* and 7*b* swing appropriately, so that the dancer rollers 5*a* and 5*b* move in a direction for increasing the length of the traveling path of the cut paper web W1 between the adjacent guide rollers 21 and 22 and the length of the traveling path of the cut paper web W2 between the adjacent guide rollers 23 and 24. When the traveling tensions of the cut paper webs W1 and W2 increase, the movable arms 7*a* and 7*b* swing appropriately, so that the dancer rollers 5*a* and 5*b* move in a direction for decreasing the length of the traveling path of the cut paper web W1 between the adjacent guide rollers 21 and 22 and the length of the traveling path of the cut paper web W2 between the adjacent guide rollers 23 and 24.

In the dancer roller means E, the two dancer rollers 5*a* and 5*b*; i.e., the two movable arms 7*a* and 7*b*, move in an interlocked manner. Therefore, in the detection means F, a potentiometer 14 attached to the frame 32 is connected to an end portion of one of the two rotation shafts 6*a* and 6*b* (the rotation shaft 6*b* in the illustrated example), the end portion projecting outward from the frame 32. Thus, the potentiometer 14 detects the rotational position of the rotation shaft 6*b*; i.e., the angular position of the movable arm 7*b*. Through detection of the angular position of the movable arm 7*b*, the position of the dancer roller 5*b* and the position of the dancer roller 5*a* interlocked with the dancer roller 5*b* can be determined.

As described above, since the two dancer rollers 5*a* and 5*b*; i.e., the two movable arms 7*a* and 7*b*, are interlocked with each other, traveling tension can be adjusted through use of the potentiometer 14 connected to either the rotation shaft 6*a* or the rotation shaft 6*b*, even in the case where a paper web is taken out of a roll paper having a width that can be used as is in the press unit R and is passed through a paper threading path for the cut paper web W2 (a paper threading path that does not pass through the angle bar section D) shown in FIG. 1 to be fed to the press unit R.

The control means G is disposed at an appropriate position. The control means G is connected to the detection means F in order to receive a detection signal from the detection means F and is connected to the drive means B in order to output a control signal in accordance with the detection signal.

In addition to the above-described guide rollers 21, 22, 23, 24, 61, and 62, other guide rollers are appropriately provided in order to define the traveling paths of the cut paper webs W1 and W2.

In the illustrated example, a guide roller 64 is provided between the bar 52 and the guide roller 21; a guide roller 65 is provided between the guide roller 62 and the guide roller 23; and guide rollers 66 and 67 are provided downstream of the guide roller 24.

The operation of the paper web feed unit of the above-described rotary press will next be described.

Before startup of the rotary press shown in FIG. 3, the paper roll W is attached to the paper web feed unit Q, and the paper web W0 taken out of the paper roll W and having a width double that used in the press units R is threaded, by means of an unillustrated threading apparatus or an operator, along the threading path extending from the paper web feed unit Q to the folding unit S via the press units R.

That is, as shown in FIG. 1, the paper web W0 is wound around the roller 2 of the feed-out means A operated upon startup of the rotary press P, and is longitudinally cut, by the action of the disk blade 4*a* of the cutting means C, into two cut paper webs W1 and W2 having substantially the same width.

The first cut paper web W1 is passed through the bars 51 and 52 of the angle bar section D, so that the center line of the first cut paper web W1 coincides with the center line of the second cut paper web W2. Subsequently, the first cut paper web W1 is engaged with the guide roller 21, wound around the dancer roller 5*a* of the dancer roller means E, and then engaged with the guide roller 22 to thereby complete the threading operation for the cut paper web W1.

The second cut paper web W2 is engaged with the guide roller 23, wound around the dancer roller 5*b* of the dancer roller means E, and then engaged with the guide roller 24 to thereby complete the threading operation for the cut paper web W2.

The thus-threaded cut paper webs W1 and W2 are passed through the respective press units R, superposed on each other, and then fed to the folding unit S by means of the drag rollers 50 (see FIG. 3).

Upon startup of the rotary press P, the threaded cut paper webs W1 and W2 are caused to travel. Subsequently, the speed of the rotary press P is increased in order to start printing, so that the speed of the cut paper web W1 traveling to the corresponding press unit R and the speed of the cut paper web W2 traveling to the corresponding press unit R increase, and a difference is produced between the speed at which the cut paper webs W1 and W2 travel to the press units R and the speed at which the paper web W0 (cut paper webs W1 and W2) is fed out by the feed-out means A. Therefore, in a region downstream of the feed-out means A, the traveling tensions of the cut paper webs W1 and W2 increase independently of each other.

Generally, the traveling tension of the cut paper web W1 passing through the angle bar section D is higher than that of the cut paper web W2, due to the influence of the angle bar section D.

Therefore, as the traveling tension increases, the dancer roller 5*a*—around which the cut paper web W1 is wound—moves toward the tensing direction of the cut paper web W1 (toward the right in FIG. 1), against the pushing pressure that is applied to the dancer roller 5*a* from the piston rod of the fluid cylinder 8*a* via the movable arm 7*a*. As a result, the movable arm 7*a* creates a clockwise angular displacement in FIG. 1; i.e., a clockwise rotation of the rotation shaft 6*a* in FIG. 1.

The clockwise angular displacement of the movable arm 7*a* is transmitted to the movable arm 7*b* via the link mechanism formed by the connecting rod 11, the coupling members 10, the shaft pins 9*a* and 9*b*, and the movable arms 7*a* and 7*b*, so that the movable arm 7*b* creates an angular displacement in synchronism with the movable arm 7*a*. Thus, the rotation shaft 6*b* rotates clockwise in FIG. 1 in synchronism with the rotation shaft 6*a*.

In response to the clockwise rotation of the rotation shaft 6*b*, control is performed in order to return the dancer rollers 5*a* and 5*b* to the respective neutral positions (ordinary positions) shown in FIG. 1. That is, in order to make the traveling tensions of the cut paper webs W1 and W2 attain their center values, the feed-out speed at which the paper web W0 (cut paper webs W1 and W2) is fed by the feed-out means A is controlled in order to follow the speeds of the cut paper webs W1 and W2 traveling to the respective press units R.

The movements of the dancer rollers 5*a* and 5*b* stemming from variations in the traveling tension of the cut paper webs W1 and W2 are detected by the potentiometer 14 as a change in the angular position of the movable arm 7*b*; i.e., in the rotational angle position of the rotation shaft 6*b*. As described above, the detection signal output from the potentiometer 14 is supplied to the control means G. Upon receipt of the detection signal, the control means G controls the motor 3 of the drive means B in order to increase the rotational frequency of the driven roller 2.

Since the circumferential speed of the driven roller 2 is increased through the above-described control, the feed-out speed of the paper web W0 (the cut paper webs W1 and W2) increases to follow the traveling speed of the cut paper webs W1 and W2 traveling to the respective press units R.

In this way, the traveling tensions of the cut paper web W1 and W2 in the dancer roller means E are decreased and maintained at a predetermined value. As a result, the dancer rollers 5*a* and 5*b* move leftward in FIG. 1 until the potentiometer 14 detects that the movable arm 7*b* has returned to a neutral or center angular position, or that the rotation shaft 6*b* has returned to a neutral or center rotational angle position, so that the movable arm 7*b* creates a counterclockwise angular displacement to return to the neutral position (ordinary position).

In this case, needless to say, the dancer rollers 5*a* and 5*b* move in an interlocked manner.

Since the cut paper web W1 is subjected to the high friction resistance of the angle bar section D during the traveling, the cut paper web W1 elastically deforms and stretches in a region downstream of the angle bar section D, and thus travels slightly slower than the cut paper web W2 in a region between the cutting means C and the angle bar section D. As result, in the region between the cutting means C and the angle bar section D, a difference in traveling tension is produced between the cut paper web W1 and the cut paper web W2, with the result that the cut paper web W1 slacks.

However, when the rotary press is operated continuously, the difference between the traveling tension of the cut paper web W1 in the region between the cutting means C and the angle bar section D and the traveling tension of the cut paper web W1 in the region downstream of the angle bar section D converges to a constant value determined from the friction resistance between the angle bar section D and the cut paper web W1, and in this state, the cut paper web W1 starts to travel at the same speed as the cut paper web W2. Therefore, no significant problems occur.

By contrast, a problem may occur when the cut paper webs W1 and W2 slack in a region between the feed-out means A and the dancer roller means E and the traveling tensions of the cut paper webs W1 and W2 decrease independently. In this case, due to decreases in traveling tension, the dancer rollers 5*a* and 5*b*—around which the cut paper webs W1 and W2 are wound—move toward the slaking direction of the cut paper webs W1 and W2 (toward the left in FIG. 1) due to the pushing pressure applied to the dancer rollers 5*a* and 5*b* from the piston rods of the fluid cylinders 8*a* and 8*b* via the movable arms 7*a* and 7*b*. However, as described above, the traveling tension of the cut paper web W1 passing through the angle bar section D is higher than that of the cut paper web W2, due to the influence of the angle bar section D. Therefore, the traveling tension of the cut paper web W1 does not decrease sufficiently.

Accordingly, the movement of the dancer roller 5*a*—around which the cut paper web W1 is wound—toward the slacking direction (toward the left in FIG. 1) is resisted to a greater extent as compared to the movement of the dancer roller 5*b*.

However, the dancer roller 5*b* follows the movement of the dancer roller 5*a* toward the slacking direction (toward the left in FIG. 1), because the movable arm 7*b* of the dancer roller 5*b* is connected to the movable arm 7*a* of the dancer roller 5*a* via the link mechanism, so that the movable arm 7*b* causes the same counterclockwise angular displacement (FIG. 1) as that of the movable arm 7*a*.

In this way, control is effected for returning the dancer rollers 5*a* and 5*b* to the respective neutral positions (ordinary positions) shown in FIG. 1. That is, the feed-out speed at which the paper web W0 (the cut paper webs W1 and W2) is fed out by the feed-out means A is controlled to follow the traveling speed of the cut paper webs W1 and W2 traveling to the respective press units R.

Specifically, as described above, the movements of the dancer rollers 5*a* and 5*b* stemming from variations in the traveling tension of the cut paper webs W1 and W2 are detected by the potentiometer 14 as a change in the angular position of the movable arm 7*b*; i.e., in the rotational angle position of the rotation shaft 6*b*, and the detection signal output from the potentiometer 14 is supplied to the control means G. Upon receipt of the detection signal, the control means G controls the motor 3 of the drive means B in order to decrease the rotational frequency of the driven roller 2.

Since the circumferential speed of the driven roller 2 is decreased through the above-described control, the feed-out speed of the paper web W0 (the cut paper webs W1 and W2) decreases relative to the traveling speed of the cut paper webs W1 and W2 traveling to the respective press units R. Consequently, the traveling tensions of the cut paper web W1 and W2 in the dancer roller means E are increased and maintained at a predetermined value. As a result, the dancer rollers 5*a* and 5*b* move rightward in FIG. 1 until the potentiometer 14 detects that the movable arm 7*b* has returned to the neutral or center angular position, or that the rotation shaft 6*b* has returned to the neutral or center rotational angle position, so that the movable arm 7*b* creates a clockwise angular displacement to return to the neutral position (ordinary position).

When low speed operation and stoppage of the rotary press are performed repeatedly many times within a short period of time; for example, in a work step in which an operator attaches a printing plate onto a plate cylinder, the traveling tensions of the cut paper webs W1 and W2 increase due to operation of the rotary press, so that the dancer rollers 5*a* and 5*b* move simultaneously toward the tensing direction of the cut paper webs W1 and W2 (rightward in FIG. 1).

The press units of the rotary presses are designed to operate at the same speed and cause the cut paper webs W1 and W2 to travel at the same speed.

Accordingly, when the traveling tension applied from the cut paper web W1 to the dancer roller 5*a* is compared with the traveling tension applied from the cut paper web W2 to the dancer roller 5*b*, the traveling tension applied from the cut paper web W1 to the dancer roller 5*a* is understood to be greater than that applied from the cut paper web W2 to the dancer roller 5*b*, by an amount corresponding to a traveling delay caused by the friction resistance of the angle bar section D.

Therefore, the two dancer rollers 5*a* and 5*b* move in an interlocked manner in accordance with variation in the traveling tension of the cut paper web W1, and the cut paper web W2 travels along the dancer roller 5*b* in a slightly slacked state.

Meanwhile, as described above, the cut paper web W1 slacks in the region between the cutting means C and the angle bar section D, due to the friction resistance of the angle bar section D. The slack of the cut paper web W1 generated in a limited region causes slack of the cut paper web W2 which is cut from the paper web W0 from which the cut paper web W1 is also cut, with the result that the slack of the cut paper web W1 and the slack of the cut paper web W2 both occur at a location downstream and in the vicinity of the cutting means C.

Accordingly, even when the cut paper webs W1 and W2 are caused to travel simultaneously upon a speed increasing operation after the start of printing, no large difference in traveling tension is produced between the cut paper webs W1 and W2 in a region immediate after the cutting means C, so that both the cut paper web W1 and the cut paper web W2 can travel smoothly.

Obviously, numerous modifications and variations of the present invention are possible in light of the above teachings. It is therefore to be understood that within the scope of the appended claims, the present invention may be practiced otherwise than as specifically described herein.

What is claimed is:

1. A paper web feed unit used in a rotary press in which a paper web taken out of a paper roll passes through the paper web feed unit and a press unit along a paper threading path having guide rollers, the paper web feed unit comprising:

feed-out means which is rotated by drive means and is adapted to feed to a downstream side the paper web wound around the outer circumferential surface of the feed-out means, by means of frictional force between the outer circumferential surface of the feed-out means and the paper web;

cutting means for cutting the traveling paper web into first and second cut paper webs having substantially the same width;

an angle bar section comprising angle bars around which only the first cut paper web is wound, the angle bar having two parallel bars which are disposed with a predetermined distance therebetween such that the bars skew with respect to the driven roller so that the traveling path of the first cut paper web is transferred; and a paper web traveling tension controller for controlling the traveling tensions of the first and second cut paper webs in a region downstream of the angle bar section, wherein the paper web traveling tension controller comprises:

dancer roller means including a first rotatable dancer roller around which the first cut paper web passing through the angle bar section is wound, and a second rotatable dancer roller around which the second cut paper web not passing through the angle bar section is wound, the first and second dancer rollers being moved in a synchronized manner by a link mechanism in order to change the lengths of respective traveling paths along which the first and second cut paper webs travel, and a predetermined pushing pressure being applied to each of the first and second dancer rollers in a direction for increasing the length of the traveling path of the corresponding cut paper web;

detection means for detecting the positions of the first and second dancer rollers; and control means for receiving a detection signal output from the detection means and for outputting a control signal to the drive means in order to control the rotational frequency of a driven roller of the feed-out means to thereby maintain each of the first and second dancer rollers at a constant position.

2. A paper web feed unit according to claim 1, wherein the dancer roller means further comprises a first movable arm having a free end which rotatably supports the first dancer roller, a second movable arm having a free end which rotatably supports the second dancer roller, pressing means for individually applying a pushing pressure to each of the first and second movable arms in order to move the corresponding dancer roller toward a direction for increasing the length of the traveling path of the cut paper web wound around the corresponding dancer roller, and a link for coupling the first and second movable arms to each other such that the first and second dancer rollers move simultaneously in a synchronized manner; and the detection means detects positions of the first and second dancer rollers through detection of an angular position of one of the first and second movable arms.

3. A paper web feed unit according to claim 1, wherein the angle bar section comprises two parallel bars which are disposed with a predetermined distance therebetween such that the bars skew with respect to the driven roller, whereby the traveling path of the first cut paper web wound around the bars is transferred to become parallel to the traveling path of the second cut paper web not passing through the angle bar section.

4. A paper web feed unit according to claim 2, wherein the traveling path of the first cut paper web wound around the bars is transferred to become parallel to the traveling path of the second cut paper web not passing through the angle bar section.

5. A paper web feed unit according to claim 1, wherein the cutting means comprises an annular groove formed on the outer circumferential surface of the driven roller, a disk blade supported such that a circumferential cutting edge of the disk blade can enter the annular groove, and drive means for rotating the disk blade.

6. A paper web feed unit according to claim 2, wherein the cutting means comprises an annular groove formed on the outer circumferential surface of the driven roller, a disk blade supported such that a circumferential cutting edge of the disk blade can enter the annular groove, and drive means for rotating the disk blade.

7. A paper web feed unit according to claim 3, wherein the cutting means comprises an annular groove formed on the outer circumferential surface of the driven roller, a disk blade supported such that a circumferential cutting edge of the disk blade can enter the annular groove, and drive means for rotating the disk blade.

8. A paper web feed unit according to claim 4, wherein the cutting means comprises an annular groove formed on the outer circumferential surface of the driven roller, a disk blade supported such that a circumferential cutting edge of the disk blade can enter the annular groove, and drive means for rotating the disk blade.

* * * * *